US005370575A

United States Patent [19]

Geib et al.

[11] Patent Number: 5,370,575

[45] Date of Patent: Dec. 6, 1994

[54] COIN SORTING MECHANISM

[75] Inventors: Joseph J. Geib, Mount Prospect; Juan J. Malave, Chicago, both of Ill.

[73] Assignee: Cummins-Allison Corp., Mt. Prospect, Ill.

[21] Appl. No.: 177,908

[22] Filed: Jan. 6, 1994

[51] Int. Cl.[5] ..... G07D 3/00

[52] U.S. Cl. ..... 453/3; 453/10

[58] Field of Search ..... 453/3, 6, 10, 49, 57, 453/63

[56] References Cited

U.S. PATENT DOCUMENTS 4,086,928 5/1978 Ristvedt et al. .
4,098,280 7/1978 Ristvedt et al. .
4,234,003 11/1980 Ristvedt et al. .
4,444,212 4/1984 Ristvedt et al. .
4,506,685 3/1985 Childers et al. .
4,531,531 7/1985 Johnson et al. .
4,543,969 10/1985 Rasmussen .
4,549,561 10/1985 Johnson et al. .
4,557,282 12/1985 Childers et al. .
4,564,036 1/1986 Ristvedt .
4,564,037 1/1986 Childers et al. .
4,570,655 2/1986 Raterman .
4,586,522 5/1986 Taipale et al. .
4,607,649 8/1986 Taipale et al. .
4,620,559 11/1986 Childers et al. .
4,681,128 7/1987 Ristvedt et al. .
4,731,043 3/1988 Ristvedt et al. .
4,753,624 6/1988 Adams et al. .
4,775,353 10/1988 Childers et al. .
4,775,354 10/1988 Rasmussen et al. .
4,863,414 9/1989 Ristvedt et al. .
4,921,463 5/1990 Primdahl et al. .
4,966,570 10/1990 Ristvedt et al. .
5,009,627 4/1991 Rasmussen .
5,011,455 4/1991 Rasmussen .
5,022,889 6/1991 Ristvedt et al. .
5,026,320 6/1991 Rasmussen .
5,066,262 11/1991 Abe ..... 453/57
5,098,340 3/1992 Abe ..... 453/57
5,106,338 4/1992 Rasmussen et al. .
5,123,873 6/1992 Rasmussen .
5,141,443 8/1992 Rasmussen et al. .
5,197,919 3/1993 Geib et al. .

*Primary Examiner*—Michael S. Huppert
*Assistant Examiner*—Scott L. Lowe
*Attorney, Agent, or Firm*—Arnold, White & Durkee

[57] ABSTRACT

A disc-type coin sorter comprises a rotatable disc having a resilient top surface and a stationary sorting head having a lower surface positioned parallel to the upper surface of the disc and spaced slightly therefrom. The lower surface presses coins of all denominations downwardly into the resilient top surface at predetermined sections thereof. These predetermined sections include a multiplicity of dimples filled with a solid lubricant for preventing the coins from galling the lower surface of the sorting head at the predetermined sections.

10 Claims, 4 Drawing Sheets

COIN SORTING MECHANISM

FIELD OF THE INVENTION

The present invention relates generally to coin sorting devices and, more particularly, to coin sorters of the type which use a resilient rotating disc and a stationary sorting head for sorting coins of mixed denominations.

BACKGROUND OF THE INVENTION

In coin sorters of the foregoing type, coins are pressed into a resilient disc for positive control substantially throughout referencing, sorting and ejection movements. Such positive control permits the coin sorter to be quickly stopped by braking of the rotation of the resilient disc when a preselected number of coins of a selected denomination have been ejected from the sorter. Positive control also permits the sorter to be relatively compact yet operate at high speed.

A disadvantage of obtaining positive control of coins by pressing the coins into engagement with a metal sorting head is that some coins, especially foreign coins composed of aluminum, tend to gall the surface of the sorting head due to the friction caused by relative movement between the coins and the sorting head. The galled surface of the sorting head can result in missorting of coins.

SUMMARY OF THE INVENTION

Accordingly, an object of the present invention is to provide a coin sorter which minimizes missorting by preventing coins from galling the surface of the sorting head.

In accordance with the foregoing object, the present invention provides a disc-type coin sorter comprising a rotatable disc having a resilient top surface and a stationary sorting head having a lower surface positioned parallel to the upper surface of the disc and spaced slightly therefrom. The lower surface of the sorting head presses coins of all denominations downwardly into the resilient top surface at predetermined sections thereof. These predetermined sections are provided with means for preventing the coins from galling the lower surface of the sorting head at the predetermined sections. The lower surface of the sorting head forms a queuing region for aligning the outer edges of the coins at a common radius, and a plurality of exit channels for receiving the queued coins and guiding coins of different diameters to different exit stations along the periphery of the sorting head.

In the preferred embodiment, the predetermined sections of the lower surface of the sorting head are provided with a multiplicity of small dimples or depressions filled with a lubricant to prevent the coins from galling the lower surface of the sorting head at the predetermined sections.

BRIEF DESCRIPTION OF THE DRAWINGS

Other objects and advantages of the invention will become apparent upon reading the following detailed description and upon reference to the drawings in which.

Figure 1:
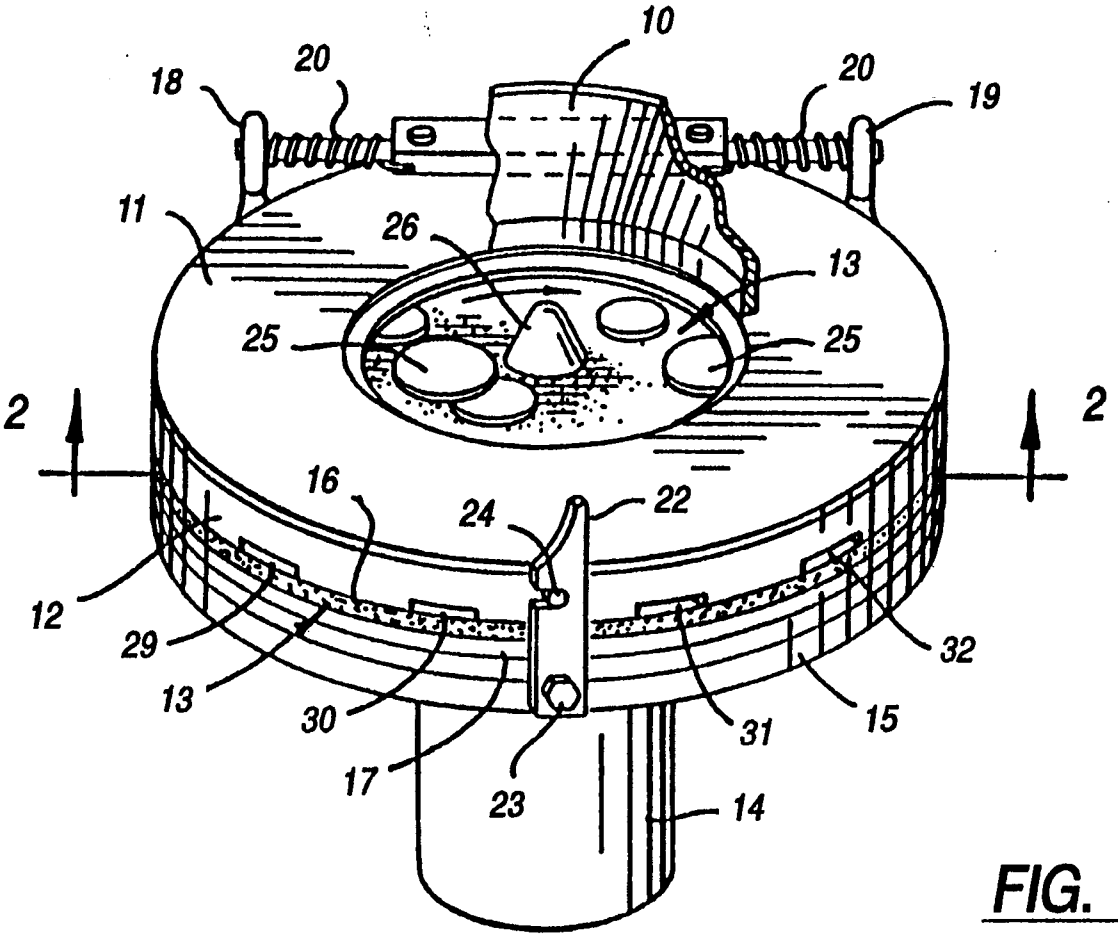
FIG. 1 is perspective view of a coin sorter embodying the present invention, with a top portion thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF THE PREFERRED EMBODIMENT

Turning now to the drawings and referring first to FIG. 1, a hopper 10 receives coins of mixed denominations and feeds them through central openings in a housing 11 and an annular sorting head or guide plate 12 inside or underneath the housing. As the coins pass through these openings, they are deposited on the top surface of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17.

The top surface of the resilient pad 16 is preferably spaced from the lower surface of the sorting head 12 by a gap of about 0.005 inches (0.13 mm). The gap is set around the circumference of the sorting head 12 by a three point mounting arrangement including a pair of rear pivots 18, 19 loaded by respective torsion springs 20 which tend to elevate the forward portion of the sorting head. During normal operation, however, the forward portion of the sorting head 12 is held in position by a latch 22 which is pivotally mounted to the frame 15 by a bolt 23. The latch 22 engages a pin 24 secured to the sorting head. For gaining access to the opposing surfaces of the resilient pad 16 and the sorting head, the latch is pivoted to disengage the pin 24, and the forward portion of the sorting head is raised to an upward position (not shown) by the torsion springs 20.

As the disc 13 is rotated, the coins 25 deposited on the top surface thereof tend to slide outwardly over the surface of the pad due to centrifugal force. The coins 25, for example, are initially displaced from the center of the disc 13 by a cone 26, and therefore are subjected to sufficient centrifugal force to overcome their static friction with the upper surface of the disc. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin. As further described below, the coins are sorted into their respective denominations, and the coins for each denomination issue from a respective exit slot, such as the slots 27, 28, 29, 30, 31 and 32 for dimes, pennies, nickels, quarters, dollars, and half-dollars, respectively.

In general, the coins for any given currency are sorted by the variation in diameter for the various denominations. The coins circulate between the sorting head and the rotating disc until a single-file stream of coins is obtained. One edge of the coins in this stream of coins is aligned, and possibly adjusted somewhat based on coin thickness, so that the other edge of the coins is subsequently gaged against gaging surfaces for directing the coins to the exit slots for the respective denominations.

Preferably most of the aligning, referencing, sorting, and ejecting operations are performed when the coins are pressed into engagement with the lower surface of the sorting head 12. In other words, the distance between the lower surfaces of the sorting head 12 with the passages conveying the coins and the upper surface of the rotating disc 13 is less than the thickness of the coins being conveyed. As mentioned above, such positive control permits the coin sorter to be quickly stopped by braking the rotation of the disc 13 when a preselected number of coins of a selected denomination have been ejected from the sorter. Positive control also permits the sorter to be relatively compact yet operate at high speed. The positive control, for example, permits the single file stream of coins to be relatively dense, and ensures that each coin in this stream can be directed to a respective exit slot instead, for example, of being recirculated.

Figure 2:
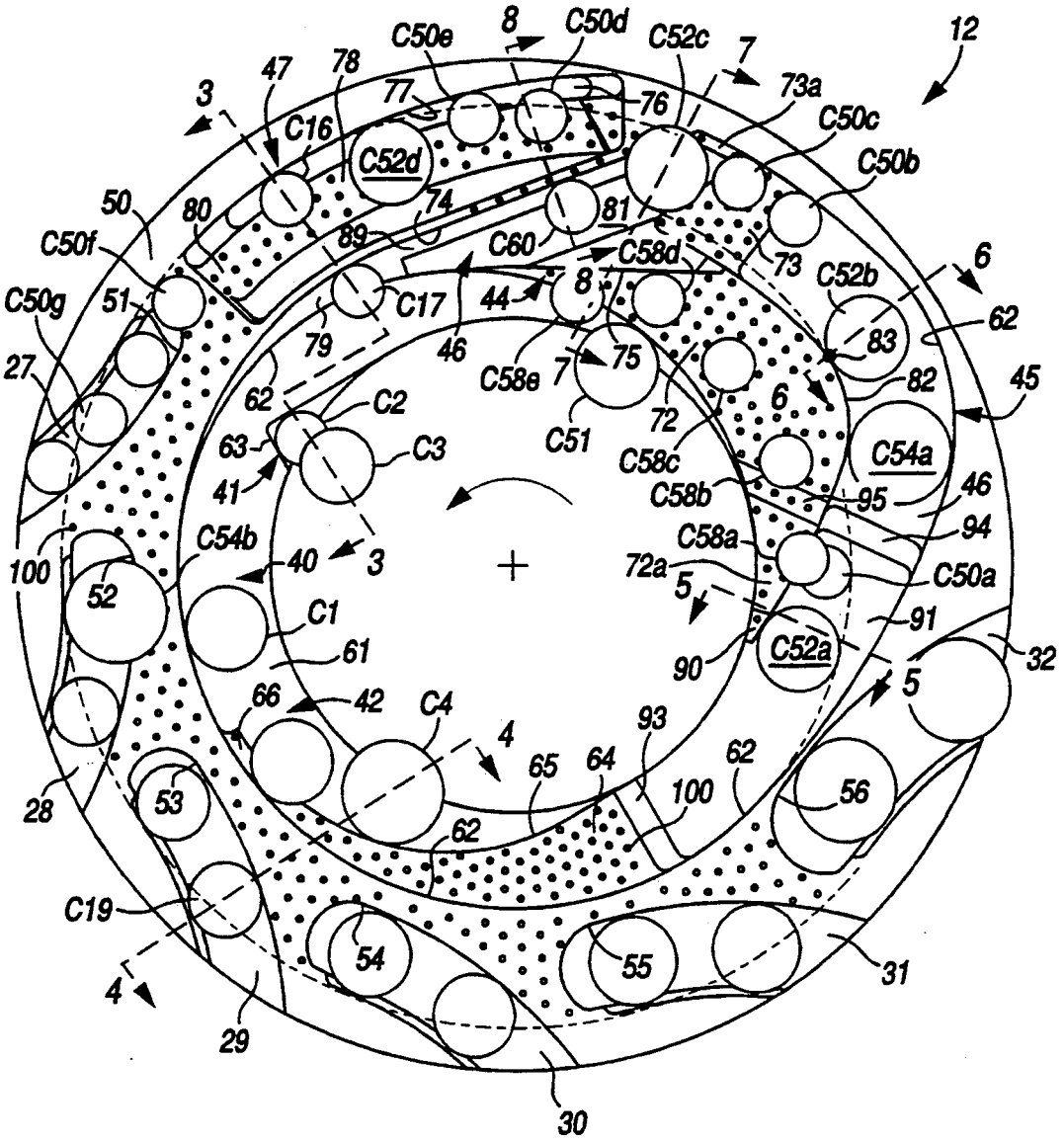
FIG. 2 is an enlarged horizontal section taken generally along line 2—2 in FIG. 1.

Turning now to FIG. 2, there is shown a bottom view of the preferred sorting head 12 including various channels and other means especially designed for high-speed sorting with positive control of the coins, yet avoiding the galling problem. It should be kept in mind that the circulation of the coins, which is clockwise in FIG. 1, appears counterclockwise in FIG. 2 because FIG. 2 is a bottom view. The various means operating upon the circulating coins include an entrance region 40, means 41 for stripping "shingled" coins, means 42 for selecting thick coins, first means 44 for recirculating coins, first referencing means 45 including means 46 for recirculating coins, second referencing means 47, and the exit means 27, 28, 29, 30, 31 and 32 for six different coin denominations, such as dimes, pennies, nickels, quarters, dollars and half-dollars. The lowermost surface of the sorting head 12 is indicated by the reference numeral 50.

Considering first the entrance region 40, the outwardly moving coins initially enter under a semi-annular region underneath a planar surface 61 formed in the underside of the guide plate or sorting head 12. Coin C1, superimposed on the bottom plan view of the guide plate in FIG. 2 is an example of a coin which has entered the entrance region 40.

Free radial movement of the coins within the entrance region 40 is terminated when they engage a wall 62, though the coins continue to move circumferentially along the wall 62 by the rotational movement of the pad 16, as indicated by the central arrow in the counterclockwise direction in FIG. 2. To prevent the entrance region 40 from becoming blocked by shingled coins, the planar region 61 is provided with an inclined surface 41 forming a wall or step 63 for engaging the upper most coin in a shingled pair. In FIG. 2, for example, an upper coin C2 is shingled over a lower coin C3. As further shown in FIG. 3, movement of the upper coin C2 is limited by the wall 63 so that the upper coin C2 is forced off of the lower coin C3 as the lower coin is moved by the rotating disc 13.

Figure 4:
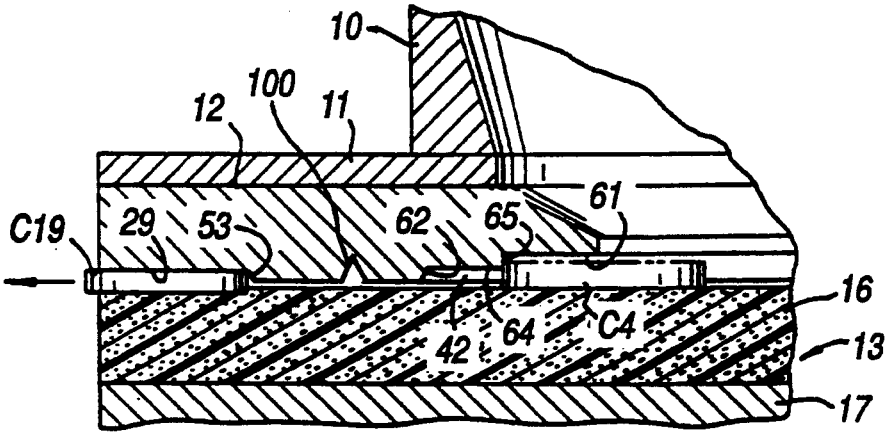
FIG. 4 is an enlarged section taken generally along line 4—4 in FIG. 2, showing in full elevation a nickel registered with an ejection recess.
Figure 6:
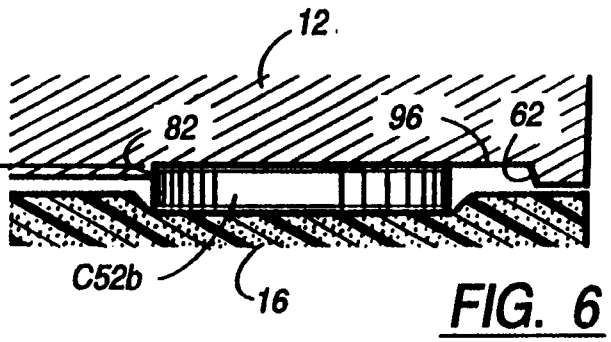
FIG. 6 is an enlarged section taken generally along line 6—6 in FIG. 2.
Figure 5:
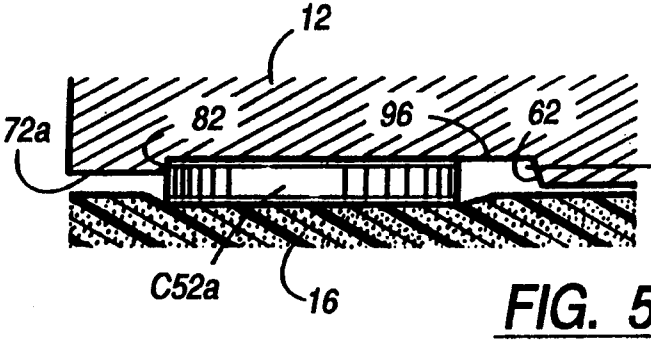
FIG. 5 is an enlarged section taken generally along line 5—5 in FIG. 2.
Figure 7:
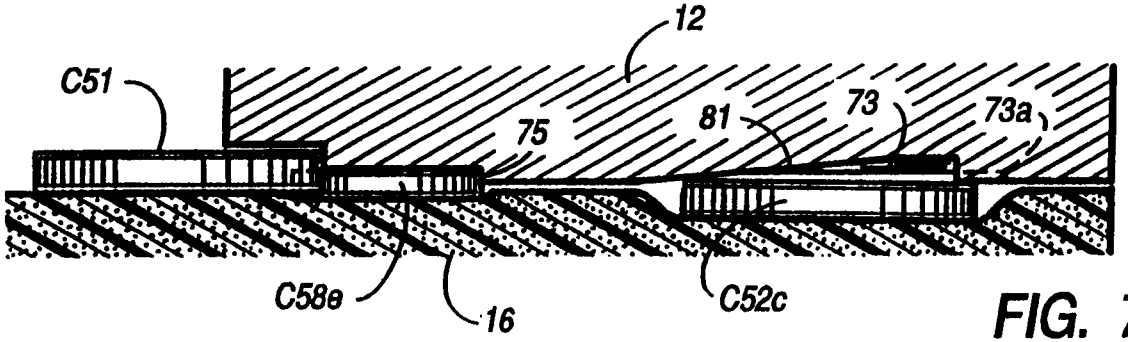
FIG. 7 is an enlarged section taken generally along line 7—7 in FIG. 2.
Figure 8:
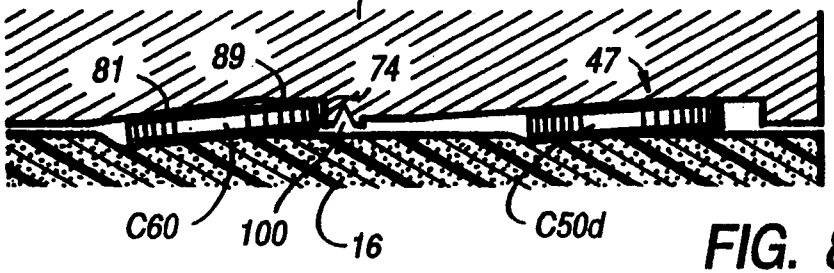
FIG. 8 in an enlarged section taken generally along line 8—8 in FIG. 2.

Returning to FIG. 2, the circulating coins in the entrance region 40, such as the coin C1, are next directed to the means 42 for selecting thick coins. This means 42 includes a surface 64 recessed into the sorting head 12 at a depth of 0.070 inches (1.78 mm) from the lowermost surface 50 of the sorting head. Therefore, a step or wall 65 is formed between the surface 6 1 of the entrance region 40 and the surface 64. The distance between the surface 64 and the upper surface of the disc 13 is therefore about 0.075 inches so that all but relatively thick coins between the surface 64 and the disc 13 are held by pad pressure. To initially engage such thick coins, an initial portion of the surface 64 is formed with a ramp 66 located adjacent to the wall 62. Therefore, as the disc 13 rotates, thick coins in the entrance region that are next to the wall 62 are engaged by the ramp 66 and thereafter their radial position is fixed by pressure between the disc and the surface 64. Thick coins which fail to initially engage the ramp 66, however, engage the wall 65 and are therefore recirculated back within the central region of the sorting head. This is illustrated, for example, in FIG. 4 for the coin C4. This initial selecting and positioning of the thick coins prevents misaligned thick coins from hindering the flow of coins to the first referencing means 45.

Returning now to FIG. 2, the ramp 66 in the means 42 for selecting the thick coins can also engage a pair or stack of thin coins. Such a stack or pair of thin coins will be carded under pad pressure between the surface 64 and the rotating disc 13. In the same manner as a thick coin, such a pair of stacked coins will have its radial position fixed and will be carried toward the first referencing means 45. The first means 45 for referencing the coins obtains a single-file stream of coins directed against the outer wall 62 and leading up to a ramp 73.

Coins are introduced into the referencing recess 45 by the thinner coins moving radially outward via centrifugal force, or by the thicker coin(s) **C52*a* following concentricity via pad pressure. The stacked coins C58*a* and C50*a* are separated at the inner wall 82 such that the lower coin C58*a* is carried against surface 72*a*. The progression of the lower coin C58*a* is depicted by its positions at C58*b*, C58*c*, C58*d*, and C58*e*. More specifically, the lower coin C58 becomes engaged between the rotating disc 13 and the surface 72 in order to carry the lower coin to the first recirculating means 44, where it is recirculated by the wall 75 at positions C58*d* and C58*e*. At the beginning of the wall 82, a ramp 90 is used to recycle coins not fully between the outer and inner walls 62 and 82 and under the sorting head 12. As shown in FIG. 2, no other means is needed to provide a proper introduction of the coins into the referencing recess 45**.

The referencing recess 45 is further recessed over a region 91 of sufficient length to allow the coins C54 of the widest denomination to move to the outer wall 62 by centrifugal force. This allows coins C54 of the widest denomination to move freely into the referencing recess 45 toward its outer wall 62 without being pressed between the resilient pad 16 and the sorting head 12 at the ramp 90. The inner wall 82 is preferably constructed to follow the contour of the recess ceiling. The region 91 of the referencing recess 45 is raised into the head 12 by ramps 93 and 94, and the consistent contour at the inner wall 82 is provided by a ramp 95. For example, for Dutch coins, a 0.030 inch step is maintained along the wall 82; the region 91 may extend clockwise about 32 degrees between ramps 93 and 94 with respect to the center of the sorting head 12 and may be recessed 0.095 inch from the top surface of the resilient disc 13 or 0.090 inch from the lowest point surface of the resilient disc 13; and the region 91 may be recessed 0.070 inch.

The first referencing recess 45 is sufficiently deep to allow coins C50 having a lesser thickness to be guided along the outer wall 62 by centrifugal force, but sufficiently shallow to permit coins C52, C54 having a greater thickness to be pressed between the pad 16 and the sorting head 12, so that they are guided along the inner wall 82 as they move through the referencing recess 45. The referencing recess 45 includes a section 96 which bends such that coins C52, which are sufficiently thick to be guided by the inner wall 82 but have a width which is less than the width of the referencing recess 45, are carried away from the inner wall 82 from a maximum radial location 83 on the inner wall toward the ramp 73.

This configuration in the sorting head 12 allows the coins of all denominations to converge at a narrow ramped finger **73*a* on the ramp 73, with coins C54 having the largest width being carried between the inner and outer walls via the surface 96 to the ramped finger 73*a* so as to bring the outer edges of all coins to a generally common radial location. By directing the coins C50 radially inward along the latter portion of the outer wall 62, the probability of coins being offset from the outer wall 62 by adjacent coins and being led onto the ramped finger 73*a* is significantly reduced. Any coins C50 which are slightly offset from the outer wall 62 while being led onto the ramp finger 73*a* may be accommodated by moving the edge 51 of exit recess 48 radially inward, enough to increase the width of the recess 48 to capture offset coins C50 but to prevent the capture of coins of the larger denominations. For sorting Dutch coins, the width of the ramp finger 73*a* may be about 0.140 inch. At the terminal end of the ramp 73, the coins become firmly pressed into the pad 16 and are carried forward to the second referencing means 47**.

A coin such as the coin **C50*c* will be carried forward to the second referencing means 47 so long as a portion of the coin is engaged by the narrow ramped finger 73*a* on the ramp 73. If a coin is not sufficiently close to the wall 62 so as to be engaged by this ramped finger 73*a*, then the coin strikes a wall 74 defined by the second recirculating means 46, and that coin is recirculated back to the entrance region 40**.

The first recirculating means 44, the second recirculating means 46 and the second referencing means 47 are defined at successive positions in the sorting head 12. It should be apparent that the first recirculating means 14, as well as the second recirculating means 46, recirculate the coins under positive control of pad pressure. The second referencing means 47 also uses positive control of the coins to align the outer most edge of the coins with a gaging wall 77. For this purpose, the second referencing means 47 includes a surface 76, for example, at 0.110 inches (1.27 mm) from the bottom surface of the sorting head 12, and a ramp 78 which engages the inner edge portions of the coins, such as the coin **C50*d***.

Figure 3:
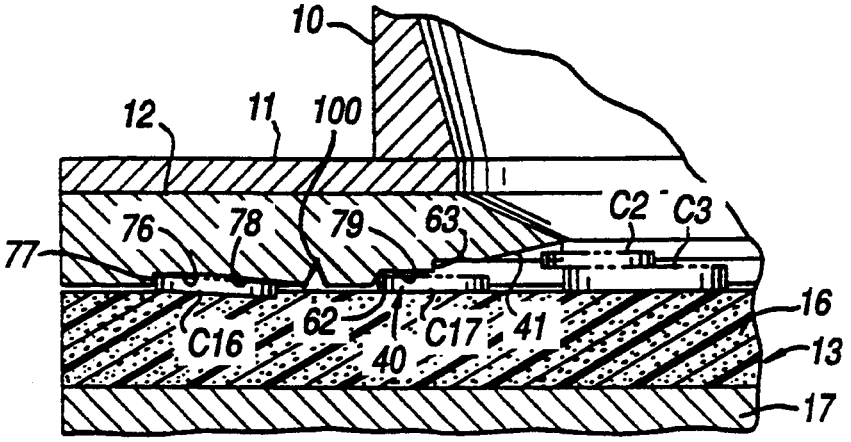
FIG. 3 is an enlarged section taken generally along line 3—3 in FIG. 2, showing the coins in full elevation.

As best shown in FIG. 2, the initial portion of the gaging wall 77 is along a spiral path with respect to the center of the sorting head 12 and the sorting disc 13, so that as the coins are positively driven in the circumferential direction by the rotating disc 13, the outer edges of the coins engage the gaging wall 77 and are forced slightly radially inward to a precise gaging radius, as shown for the coin C16 in FIG. 3. FIG. 3 further shows a coin C17 having been ejected from the second recirculating means 46.

The second referencing means 47 terminates with a slight ramp 80 causing the coins to be firmly pressed into the pad 16 on the rotating disc with their outer most edges aligned with the gaging radius provided by the gaging wall 77. At the terminal end of the ramp 80 the coins are gripped between the guide plate 12 and the resilient pad 16 with the maximum compressive force. This ensures that the coins are held securely in the new radial position determined by the wall 77 of the second referencing means 47.

The sorting head 12 further includes sorting means comprising a series of ejection recesses 27, 28, 29, 30, 31 and 32 spaced circumferentially around the outer periphery of the plate, with the innermost edges of successive slots located progressively farther away from the common radial location of the outer edges of all the coins for receiving and ejecting coins in order of increasing diameter. The width of each ejection recess preferably is smaller than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

The innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess.

For example, the first ejection recess 27 is intended to discharge only dimes, and thus the innermost edge 51 of this recess is located at a radius that is spaced inwardly from the radius of the gaging wall 77 by a distance that is only slightly greater than the diameter of a dime. Consequently, only dimes can enter the recess 27. Because the outer edges of all denominations of coins are located at the same radial position when they leave the second referencing means 47, the inner edges of the pennies, nickels, quarters, dollars and half dollars all extend inwardly beyond the innermost edge of the recess 27, thereby preventing these coins from entering that particular recess.

At recess 28, the inner edges of only pennies are located close enough to the periphery of the sorting head 12 to enter the recess. The inner edges of all the larger coins extend inwardly beyond the innermost edge 52 of the recess 28 so that they remain gripped between the guide plate and the resilient pad. Consequently, all the coins except the pennies continue to be rotated past the recess 28.

Similarly, only nickels enter the ejection recess 29, only the quarters enter the recess 30, only the dollars enter the recess 31, and only the half dollars enter the recess 32.

Because each coin is gripped between the sorting head 12 and the resilient pad 16 throughout its movement through the ejection recess, the coins are under positive control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

In order to prevent coins from galling the sorting head 12 in regions where the coins are pressed by the sorting head 12 into the resilient pad 16, selected regions of the sorting head 12 are provided with gall-resistant means. In particular, the selected regions are machined to form a multiplicity of small dimples or depressions 100 filled with a solid lubricant. The dimples 100 may be filled with the lubricant by rubbing a solid stick of the lubricant back and forth across the dimpled surfaces so as to fill the dimples 100 with lubricant and, at the same time, coat the surfaces surrounding the dimples 100. The selected regions are those regions where the coins are pressed into the pad. In the sorting head 12 shown in FIG. 2, these regions include the surfaces 64, 72a, and 72; the ramps 90, 95, 78, and 80; and the dimpled portions of the lowermost surface 50 of the sorting head 12. The dimples 100 are either uniformly or randomly spaced from one another and are preferably configured in the shape of a cone. Alternatively, the dimples 100 may be configured in the shape of a rectangular or cylindrical volume.

As coins slide over the dimpled surfaces of the sorting head, minute mounts of the lubricant are dragged from the dimples onto the passing coins. A portion of this lubricant is then transferred from the coins to the solid surfaces of the sorting head that engage the coins. The end result is a significant reduction in sliding friction between the coins and the sorting head, which in turn reduces or even eliminates galling of the sorting head. The lubricant is replenished from time to time, preferably at intervals measured by the number of coins processed by the sorter. One way to replenish the lubricant is to simply rub a solid stick of the lubricant back and forth across the dimpled surfaces.

The lubricant should remain solid over the operating temperature range of the sorting head, which can be heated well above room temperature when processing large batches of coins. The lubricant should also be soft enough that it can be removed from the dimples by passing coins, small quantities at a time. In the preferred embodiment, the lubricant is "Door-Easy" lubricant (the DE-25 formula) produced by American Grease Stick Co., Muskegon, Michigan, and having a flash point of approximately 300° F.

In an alternative embodiment, the dimples 100 are substituted with small holes filled with plugs of a gall-resistant material. The locations of these small holes are represented by the reference numeral 100 in FIG. 2.

We claim:

1. A disc-type coin sorter, comprising:

a rotatable disc having a resilient top surface for receiving a plurality of coins thereon; and a stationary sorting head having a lower surface being positioned parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, the lower surface of the sorting head pressing the coins downwardly into the resilient top surface of the disc at predetermined sections of the lower surface of the sorting head, the predetermined sections including a multiplicity of spaced dimples, wherein the dimples contain means for reducing friction between the coins and the lower surface of the sorting head.

2. The coin sorter of claim 1, wherein a cross-sectional shape of said dimples is conical.

3. The coin sorter of claim 1, wherein a cross-sectional shape of said dimples is rectangular.

4. The coin sorter of claim 1, wherein a cross-sectional shape of said dimples is cylindrical.

5. The coin sorter of claim 1, wherein said means for reducing friction is a solid lubricant.

6. The coin sorter of claim 5, wherein said lubricant coats the lower surface of said sorting head at said predetermined sections.

7. The coin sorter of claim 5, wherein a cross-sectional shape of said dimples is conical.

8. The coin sorter of claim 5, wherein a cross-sectional shape of said dimples is rectangular.

9. The coin sorter of claim 5, wherein a cross-sectional shape of said dimples is cylindrical.

10. A sorting head for a disc-type coin sorter including a rotatable disc, the rotatable disc having a resilient top surface for receiving a plurality of coins thereon, the sorting head comprising:

a lower surface being positioned parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, the lower surface of the sorting head pressing the coins downwardly into the resilient top surface of the disc at predetermined sections of the lower surface of the sorting head, the predetermined sections including a multiplicity of spaced dimples, wherein the dimples contain means for reducing friction between the coins and the lower surface of the sorting head.

* * * * *